US006315800B1

(12) United States Patent
Gomes et al.

(10) Patent No.: US 6,315,800 B1
(45) Date of Patent: Nov. 13, 2001

(54) LAUNDRY CARE PRODUCTS AND COMPOSITIONS

(75) Inventors: Filomena Augusta Gomes, West Caldwell; Dennis Stephen Murphy, Leonia; Karla Jean Cicciari, Ramsey, all of NJ (US); Harry Hamilton Haubert, Sandy Hook, CT (US); Carol Caldwell Bishop, Armonk; Sherryl Ilana Zucker, New York, both of NY (US)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/293,584

(22) Filed: Apr. 16, 1999

Related U.S. Application Data

(60) Provisional application No. 60/105,866, filed on Oct. 27, 1998.

(51) Int. Cl.[7] ..... D06L 1/00; C11D 17/04

(52) U.S. Cl. ..... 8/137; 8/142; 510/295; 510/439; 510/519; 510/520

(58) Field of Search ..... 510/295, 406, 510/439, 519, 520; 8/142, 137

(56) References Cited

U.S. PATENT DOCUMENTS

| | | | | |
|---|---|---|---|---|
| 3,632,422 | | 1/1972 | Maggiolo et al. . | |
| 3,649,165 | | 3/1972 | Cotton . | |
| 3,686,025 | | 8/1972 | Morton . | |
| 3,816,167 | | 6/1974 | Schultz et al. . | |
| 3,992,332 | | 11/1976 | Zenon . | |
| 4,000,340 | | 12/1976 | Murphy et al. . | |
| 4,007,300 | | 2/1977 | McQueary . | |
| 4,012,326 | | 3/1977 | Rudy et al. . | |
| 4,017,411 | * | 4/1977 | Diehl et al. | 252/186 |
| 4,073,996 | | 2/1978 | Bedenk et al. . | |
| 4,137,345 | | 1/1979 | Falivene . | |
| 4,139,475 | * | 2/1979 | Schwadtke et al. | 252/8.6 |
| 4,170,678 | * | 10/1979 | Urfer et al. | 428/124 |
| 4,237,155 | | 12/1980 | Kardouche . | |
| 4,238,531 | | 12/1980 | Rudy et al. . | |
| 4,327,133 | | 4/1982 | Rudy et al. . | |
| 4,336,024 | | 6/1982 | Denissenko et al. . | |
| 4,389,448 | | 6/1983 | Green . | |
| 4,421,792 | | 12/1983 | Rudy et al. . | |
| 4,459,382 | | 7/1984 | Ona et al. . | |
| 4,515,703 | * | 5/1985 | Haq | 252/92 |
| 4,603,069 | | 7/1986 | Haq et al. . | |
| 4,663,198 | * | 5/1987 | Norris | 427/264 |
| 4,724,090 | | 2/1988 | Suzuki et al. . | |
| 4,733,774 | * | 3/1988 | Ping, III et al. | 206/0.5 |
| 4,735,738 | * | 4/1988 | Willman | 252/90 |
| 4,753,843 | | 6/1988 | Cook et al. . | |
| 4,767,548 | * | 8/1988 | Kasprzak et al. | 252/8.8 |
| 4,797,310 | | 1/1989 | Barby et al. . | |
| 4,800,026 | | 1/1989 | Coffindaffer et al. . | |
| 4,832,865 | | 5/1989 | Krivak et al. . | |
| 4,849,257 | | 7/1989 | Borcher, Sr. et al. . | |
| 4,911,853 | | 3/1990 | Coffindafer . | |
| 4,938,879 | | 7/1990 | Kellett . | |
| 5,066,413 | | 11/1991 | Kellett . | |
| 5,094,761 | | 3/1992 | Trinh et al. . | |
| 5,173,200 | | 12/1992 | Kellett . | |
| 5,174,911 | * | 12/1992 | Lin et al. | 252/8.6 |
| 5,208,089 | | 5/1993 | Norris . | |
| 5,234,610 | | 8/1993 | Gardlik et al. . | |
| 5,238,587 | * | 8/1993 | Smith et al. | 252/8.6 |
| 5,254,269 | * | 10/1993 | Taylor et al. | 252/86 |
| 5,264,269 | | 11/1993 | Kakiuchi et al. . | |
| 5,300,238 | * | 4/1994 | Lin et al. | 252/8.6 |
| 5,348,667 | | 9/1994 | Bacon et al. . | |
| 5,376,287 | | 12/1994 | Borcher, Sr. et al. . | |
| 5,534,165 | * | 7/1996 | Pilosof et al. | 252/8.91 |
| 5,545,342 | * | 8/1996 | Beagle et al. | 510/299 |
| 5,547,476 | | 8/1996 | Siklosi et al. . | |
| 5,591,236 | | 1/1997 | Roetker . | |
| 5,610,128 | * | 3/1997 | Zyhowski et al. | 510/288 |
| 5,630,847 | | 5/1997 | Roetker . | |
| 5,630,848 | | 5/1997 | Young et al. . | |
| 5,632,780 | | 5/1997 | Siklosi . | |
| 5,645,751 | | 7/1997 | Haley . | |
| 5,658,651 | | 8/1997 | Smith et al. . | |
| 5,670,476 | | 9/1997 | Vogel et al. . | |
| 5,681,355 | | 10/1997 | Davis et al. . | |
| 5,687,591 | | 11/1997 | Siklosi et al. . | |
| 5,726,143 | * | 3/1998 | Petraia et al. | 510/519 |
| 5,746,776 | | 5/1998 | Smith et al. . | |
| 5,762,648 | | 6/1998 | Yeazell . | |
| 5,770,548 | | 6/1998 | Leskowicz et al. . | |
| 5,789,368 | | 8/1998 | You et al. . | |
| 5,804,548 | | 9/1998 | Davis . | |
| 5,807,956 | | 9/1998 | Czech . | |
| 5,840,675 | | 11/1998 | Yeazell . | |
| 5,865,851 | | 2/1999 | Sidoti et al. . | |
| 5,965,504 | * | 10/1999 | Reynolds | 510/285 |

FOREIGN PATENT DOCUMENTS

| | | | |
|---|---|---|---|
| 0 255 711 A2 | | 2/1988 | (EP) . |
| 0 429 172 A1 | | 5/1991 | (EP) . |
| 0 544 493 A1 | | 6/1993 | (EP) . |
| 94/07980 | | 4/1994 | (WO) . |
| 96/39556 | | 12/1996 | (WO) . |
| 97/00991 | * | 1/1997 | (WO) . |
| 97/00992 | * | 1/1997 | (WO) . |
| 97/32004 | | 9/1997 | (WO) . |
| 97/32917 | | 9/1997 | (WO) . |
| 98/44185 | | 10/1998 | (WO) . |
| 98/56890 | | 12/1998 | (WO) . |
| 98/58114 | | 12/1998 | (WO) . |
| 99/10586 | | 3/1999 | (WO) . |
| 99/14421 | | 3/1999 | (WO) . |

* cited by examiner

*Primary Examiner*—Lorna M. Douyon

(57) ABSTRACT

A product for use in a conventional home clothes dryer that delivers one or more desirable benefits to clothing in need of freshening. The product us particularly suited for delivering the benefits to relatively dry clothing and can be added directly to the dryer without the need for a bag to contain the product and clothing during the dryer cycle.

3 Claims, 4 Drawing Sheets

LAUNDRY CARE PRODUCTS AND COMPOSITIONS

RELATED APPLICATIONS

This application claims priority to Provisional application Ser. No. 60/105,866 filed Oct. 27, 1998.

BACKGROUND

Commercial products available for the care of clothing and fabrics in the home are well known. These products include liquid, powder and tablet detergents, liquid and sheet fabric softeners and other various products. Professional services, such as dry cleaners, are also widely available for cleaning garments subject to shrinkage or for those that are too delicate for common washer/dryer cycles. Typically, desired results from dry cleaning/laundering clothing is stain removal, odor removal, softening, static removal and reduced wrinkling.

It is not uncommon for a garment that has recently been cleaned but briefly used to lose those properties that are generally associated with freshly cleaned clothing. Indeed, depending on the environment a fabric is subjected to, odors, wrinkles, small stains and the like can quickly render the fabric "unclean" in the eye of the user. For example, a relatively brief exposure to tobacco smoke can leave a noticeable lingering odor on otherwise clean clothing. It is also common for clean clothing to become wrinkled before they are worn, such as when the clothes are packed in a suitcase for travel. Typically, these otherwise clean clothes are either tolerated by the user or sent back through an entire cleaning process.

Therefore, there is a need for a convenient, cost effective and efficient means for reviving clothing that is not in need of a complete laundering or dry cleaning cycle.

At least one commercially available product marketed by The Procter & Gamble Company under the name "Dryel", seeks to allow for treatment of clothing in the home dryer. U.S. Pat. No. 5,681,355 is marked on the product and is incorporated herein by reference. The Dryel product consists of a plastic bag, a premoistened cloth, bottled stain removal solution and an absorbent pad for use with the stain removal solution. The user is instructed to: 1) completely remove spots and stains prior to placing garments in the bag, preferably by placing the absorbent pad under the garment; 2) add one to four garments to the bag; 3) insert a premoistened cloth into the bag containing the garments; 4) seal the bag; 5) tumble the bag, garments and cloth in the dryer for 30 minutes at medium to high heat; and 6) hang the garments promptly to help decrease wrinkling. Users of the Dryel product have complained about the need for a bag and its limited capacity and the potential for entrapment, rather than removal, of particulates. Also, the use of the bottle/pad combination to remove stains adds to the complexity of the process.

Therefore, there is also a need for a home garment cleaning process and product that does not have the known drawbacks of the Dryel product. Such a product and process would preferably eliminate the need for a garment bag and simplify the stain removal process.

It is also known to use chemicals in clothes dryers to soften, freshen and reduce static on garments. Fabric softener dryer sheets have been used for these purposes for decades and are described, for example, in U.S. Pat. Nos.: 4,237,155; 4,238,531; 4,327,133; 4,421,792, 5,094,761; 5,234,610; 5,348,667; and 5,376,287; all of which are incorporated herein by reference. To be effective, however, dryer sheets generally need to interact with damp clothing in order to deliver their intended benefits. As such, these dryer sheets are particularly suited for processing garments after removal from the washing machine and not for dry clothing in need of freshening.

Therefore, there is need for a fabric freshening, softening and/or static removing product that can deliver the desired benefits to relatively dry clothing.

Furthermore, as previously discussed, the ability to reduce or eliminate wrinkles on relatively clean clothing is also desired. Known attempts to reduce wrinkles by means of chemical ingredients in the wash include the use of zwitterionic surfactants, aminosilicones, curable aminosilicones, cellulose enzymes and alkyl amides. However, each of these ingredients have one or more drawbacks. For example, zwitterionic surfactants are believed to work best in cold water. Aminosilicones can cause yellowing and can be difficult to formulate. Curable aminosilicones require the heat of an iron to reduce wrinkles. Cellulase enzymes generally require several wash cycles before anti-wrinkle benefits become noticeable. Alkyl amides are not very effective relative to other wrinkle reducing agents.

Therefore, there is a need for wrinkle reducing formulations and products that can be used in conventional home dryers on relatively dry garments. Such formulations and products would preferably not require the undesirable bag required by the aforementioned Procter & Gamble Dryel cleaning kit.

SUMMARY

The present application relates to a product for use in a conventional home clothes dryer that delivers one or more desirable benefits to clothing in need of freshening. The product is particularly suited for delivering the benefits to relatively dry clothing and can be added directly to the dryer without the need for a bag to contain the product and clothing during the dryer cycle.

In a preferred embodiment, chemicals suitable for providing one or more of the above desirable benefits are applied to a substrate, such as a fabric-like sheet, that can be added directly to the dryer with the clothing. After running the dryer for a period of time, the freshened clothes are removed. A surprising finding is that a de-wrinkling effect can be achieved from a moist sheet in a relative short period of time. For example, de-wrinkling is evident in about 10–20 minutes using a 12"×12" substrate containing about 40 g to about 45 g of fabric treatment agent. In a most preferred embodiment, the fabric treatment agent is in liquid form and, for simplicity, the fabric treatment agent will be referred to as a liquid. However, the term "fabric treatment agent" will be understood to encompass formulations other than liquids, such as gels, creams and the like.

The substrate is preferably absorbent enough to hold a suitable amount of liquid product to deliver the desired benefits and, at the same time, not be overly saturated so as to drip or otherwise release liquid in an undesirable manner. Nonetheless, the substrate must also suitably release its liquid contents. In the disclosed embodiment wherein the substrate/liquid is intended to deliver cleaning benefits, it is preferred that the user can rub the substrate directly on noticeable stains/spots to remove or reduce the appearance of the stains/spots. The same substrate can then be added to the dryer with the clothing to complete the freshening/cleaning process. This embodiment eliminates the cumbersome bottle/pad combination for stain removal in the Dryel product.

With respect to wrinkle reduction, the ingredients that deliver this benefit are believed to lubricate fiber surfaces. By lubricating the fiber surfaces of garments, for example, the fibers slide more easily relative to each other and are less likely to entangle, resulting in less wrinkles. The preferred fiber lubricants disclosed herein have been shown to noticeably reduce the number of wrinkles. The preferred embodiments also overcome one or more of the above noted disadvantages of prior wrinkle reducing agents or methods.

DETAILED DESCRIPTION OF PREFERRED EMBODIMENTS

Figure 1:
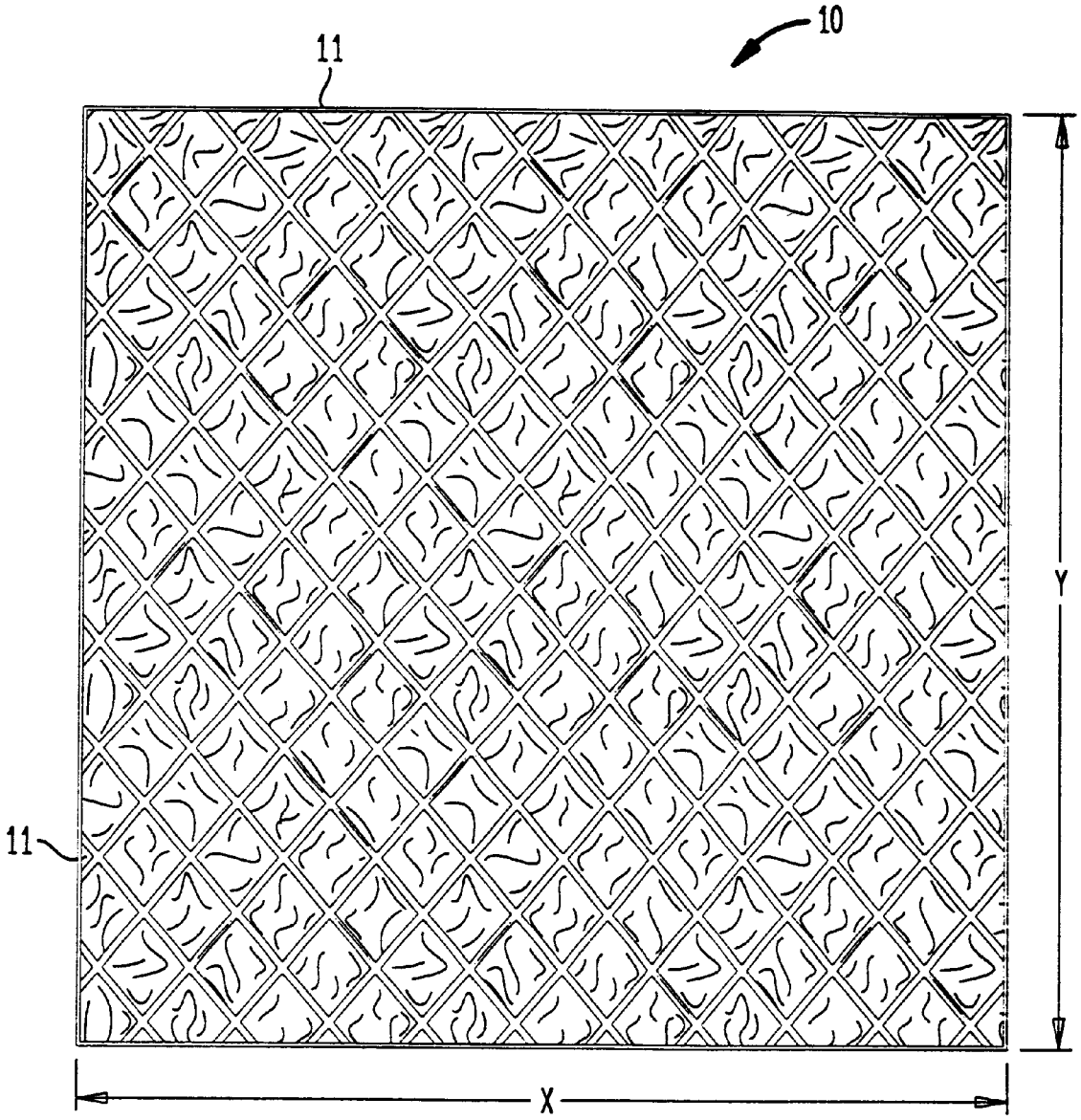
FIG. 1 is a top plan view of a first embodiment of a preferred substrate.

Turning to FIG. 1, a first embodiment of a preferred substrate 10 is shown having dimensions X and Y. Preferably, X is approximately 12" and Y is approximately 12". However, it is clearly within the scope of the invention to have dimensions X and Y different, smaller or larger depending on the amount of active ingredients desired to be placed in the dryer. It is also not necessary that the substrate be relatively flat or rectangular. When the substrate is a sheet, it preferably has first and second primary sides having generally the same dimensions, such as upper and lower layers 16*a* and 16*b* of substrate 10.

Figure 2:
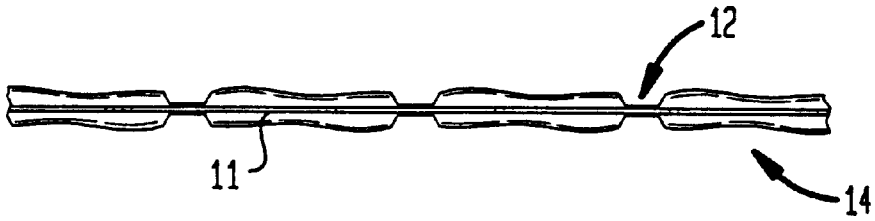
FIG. 2 is a side elevational view of a portion of FIG. 1.
Figure 3A:
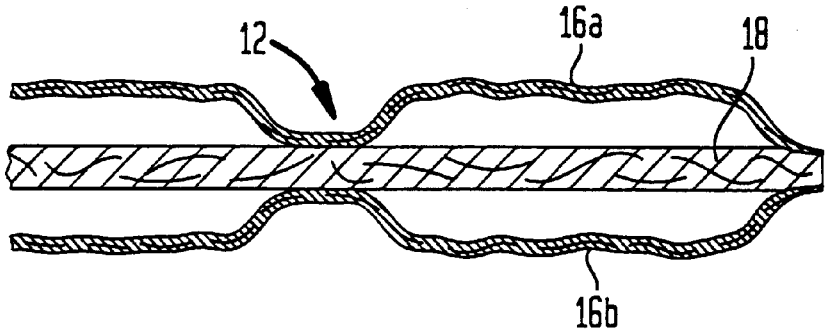
FIG. 3A is a side elevational view in partial cross section of FIG. 1.
Figure 3B:
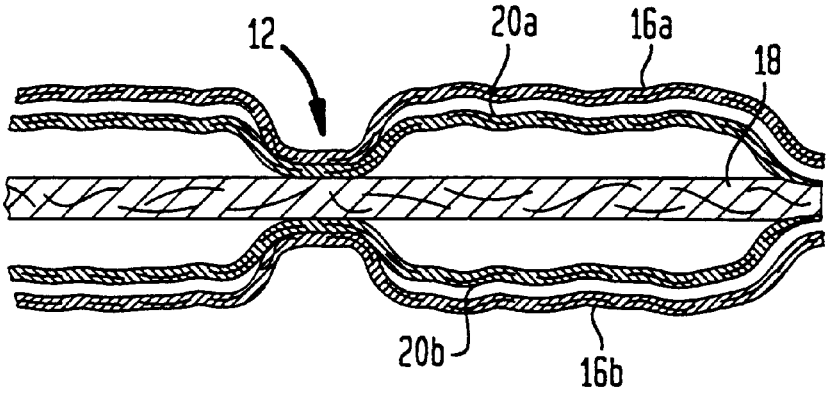
FIG. 3B is a side elevational view in partial cross section of an alternate embodiment of the substrate illustrated in FIG. 1.

With reference to FIGS. 2 and 3A, substrate 10 is fabricated from an inner layer 18 surrounded by upper and lower layers 16*a* and 16*b*. Preferably, inner layer 18 is an absorbent material that facilitates liquid retention while outer layers 16*a* and 16*b* are hydrophobic. In a most preferred embodiment, inner layer 18 is a 50/50 polypropylene/rayon blend and outer layers 16*a* and 16*b* are polyester. Because these layered materials are heat sensitive, application of heat can weld the materials together to create patterns such as those shown in FIGS. 1–3B. FIG. 2–3B show welds 12*a* joining the materials together and unwelded portions 14 that create a "puffiness" to the substrate. Most preferably, the outer edges of substrate 10 has weld 11 that seals the substrate's periphery. With respect to FIG. 3B, additional layers 20*a* and 20*b* are disposed between inner layer 18 and outer layers 16*a* and 16*b*. In this embodiment, inner intermediate layers 20*a* and 20*b* are preferably polyproplene material.

Any suitable combination of polymeric materials can be used, however, it is most preferred that the outer layer be hydrophobic so as to inhibit excessive transfer of liquids to clothing during the freshening process. It is also preferred that the outer layer has a melting point above that which can be present within a dryer during a drying cycle.

Figure 4:
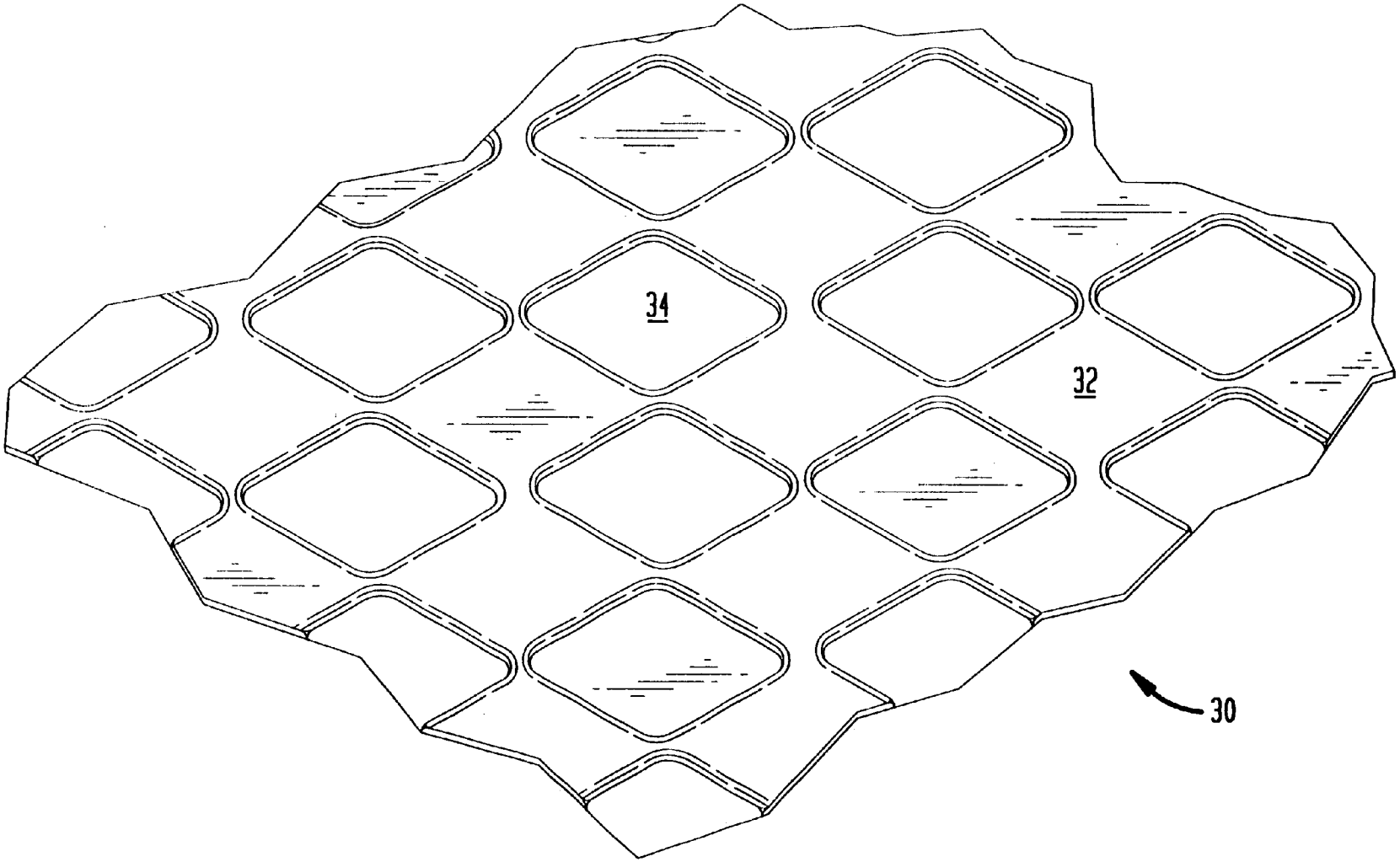
FIG. 4 is a partial top perspective view of an alternative embodiment of a preferred substrate.

Turning to FIG. 4, and alternative substrate is shown, in this embodiment, substrate 30 has alternating raised and depressed rectangular areas 32 and 34 respectively. In a most preferred embodiment, this particular substrate is a 50/50 rayon/PET blend, wherein the fabric is preferably non-woven. Substrates, such as that shown in FIG. 4, are available from PGI located in North Carolina.

Figure 5:
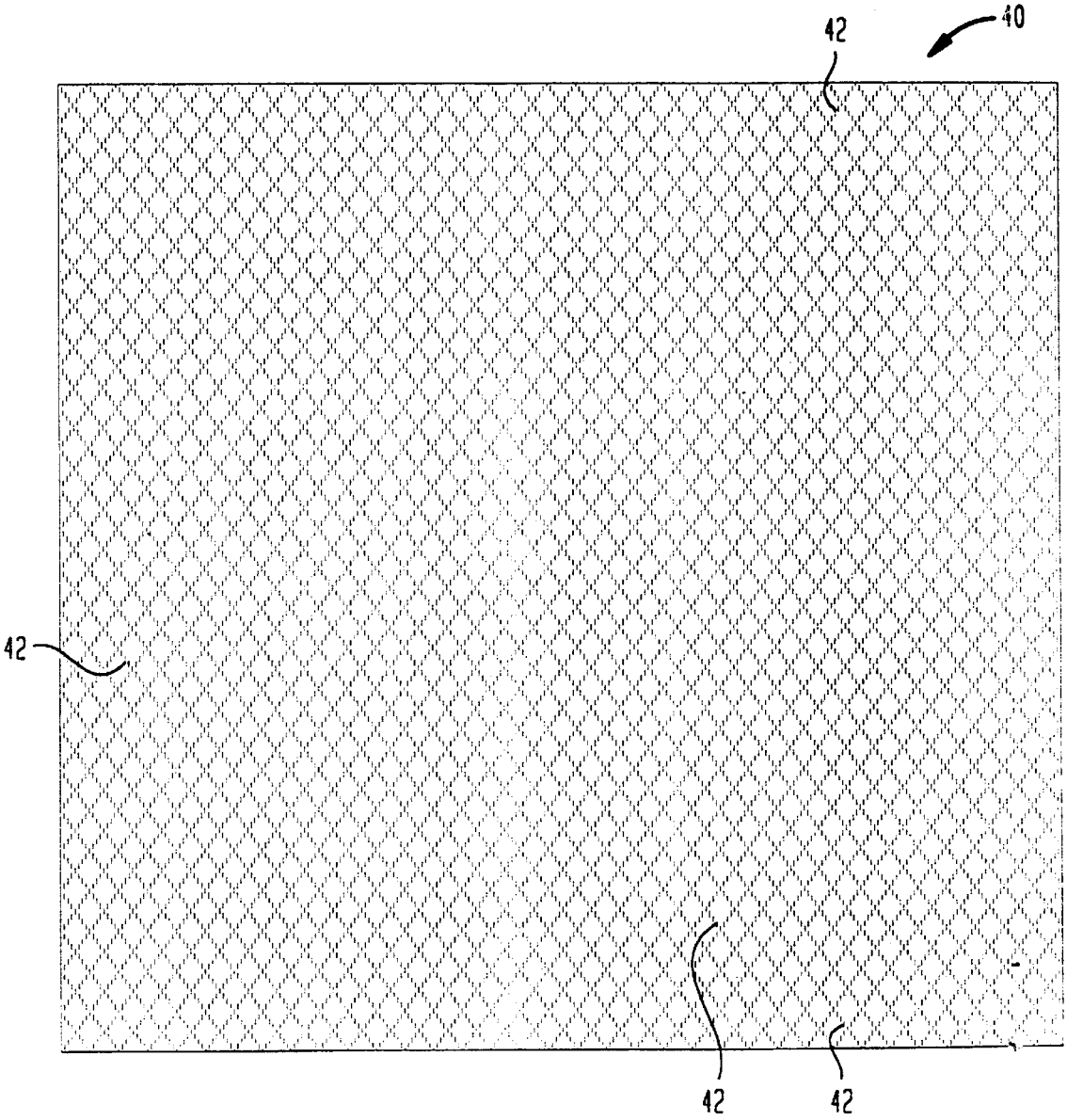
FIG. 5 is a top view of an alternative embodiment of a preferred substrate.

Yet another alternative embodiment is shown in FIG. 5. This particular fabric substrate, 40, is preferable polyester, rayon, or a combination of both. Substrate 40 has a plurality of holes 42 passing there through in a determined pattern. Substrates, such as those shown in FIG. 5, are available from PGI (under the Miratec trademark).

In each of the above substrate embodiments, it is preferable to have at least a portion of one side the substrate colored differently than a portion of the other. For example, top layer 16*a* of substrate 10 can be white while bottom layer 16*b* can be at least partially blue and, most preferably, all blue. Difference in color is herein defined as a difference in color or color intensity, i.e., 16*a* can be light blue while 16*b* can be a darker shade of blue. Of course, other colors pleasing to the consumer can also be used. In order to provide color to the non-woven substrate of FIG. 4, dyed fibers can be used during a portion of the non-woven manufacturing process. For example, white fibers are used/visible on one side of the substrate while blue fibers are used/visible on the other side of the substrate.

When used in a dryer to freshen clothing, it has been found that it preferable to deliver between about 20 and about 60 grams of liquid agent to the dryer load of 1–4 garments. It has further been found that when the above described fabric substrate sheets are in a dimension of approximately 12"×12" and have a dry weight of about 3.5 g per square yard, 40 grams of liquid material can absorbed thereon and be properly delivered to the dryer (about 0.29 grams per square inch). If 45 grams of liquid are desired, this calculates to about 0.31 grams per square inch. In embodiments where the fabric substrate is 12"×12", and the preferred liquid quantity is between 20 and 60 grams, the substrate delivers approximately 0.14 grams per square inch to about 0.42 grams per square inch.

As such, once a preferred quantity of liquid to be delivered to the dryer is known, it is possible to determine the area of substrate required. In addition, if a heavier substrate is used, it is possible to deliver greater quantities of liquid to the dryer without increasing the length and width dimensions of the substrate. As previously discussed, while the preferred substrates disclosed herein are square, it is clearly within the scope of the present invention that other shapes, such as circles, triangles and odd shapes, can also be used to deliver the proper amount of liquid.

Several molecules have been identified for wrinkle reduction and other benefits, such as static reduction benefits when included on one of the above-identified substrates and used on clothing in a dryer. Using the American Association of Textile Chemists and Colorists (AATCC) method # 124 (described in greater detail, below), the following molecular classes were found to be effective on test cloths: ethoxylated organosilicones; polyalkyleneoxide modified polydimethylsiloxane; linear aminopolydimethylsiloxane polyalkyleneoxide copolymers; sulfated/sulfonated vegetable oils; high molecular weight polyacrylamides; betaine siloxane copolymers; and alkylactam siloxane coplymers. Of the foregoing, the most preferred wrinkle reducing agent is a polyalkyleneoxide modified polydimethyl siloxane sold under the name Silwet L-7622, available from Witco, Greenwich, Conn. Adogen 66, a tallow alkyl BIS (polyethoxy) ethyl ammonium, ethyl sulfate, also available from Witco can be used in combination with one or more of the above compounds to reduce static. Use with Silwet L-7622 is preferred.

One or more of the molecules/compounds from the above-identified classes are preferably formulated in an amount from about 0.1 wt % to about 5 wt % and most preferably from about 0.3 wt % to about 1.5 wt %. Particularly preferred examples are set forth, below.

The following sets forth preferred fabric treatment formulation ranges suitable for use with a substrate:

PREFERRED FORMULATION RANGES

| CHEMICAL | % ACTIVE LEVEL IN FORMULATION |
|---|---|
| Acrylic copolymer. Carboxypolymethylene Acrylates/C10–30 alky acrylate crosspolymer. | 0.05–0.5 |
| Acrylic acid/Lauryl methacrylic acid copolymer (33% active). | 0.1–2 |
| Glycerol Triacetate-Triacetin | 2–10 |
| Ethoxylated fatty acid | 0.1–6 |
| 2-Pyrrolidinone, 1-octyl | 0.1–5 |
| Polyalkyleneoxide modified polydimethylsiloxane (Silwet L-7622) | 0.1–5 |
| Microbiocide (1.5% Active) | 0.0–0.0007 |
| Perfume | 0.1–1 |
| Deionized Water | to 100 |

The microbiocide can be eliminated if the other ingredients provide suitable biocidal activity. For example, it is believed that Glycerol Triacetate can provide such suitable activity.

The following are preferred formulations suitable for use with a substrate. While particularly preferred wt. % active levels are disclosed, the particular wt. % in the final formulation for each ingredient can vary from that which is particularly disclosed. Such wt. % levels are considered to be within the scope of the present disclosed.

| CHEMICAL | % ACTIVE LEVEL IN FORMULATION |
|---|---|
| Formulation 1 | |
| Acrylic copolymer. Carboxypolymethylene Acrylates/C10–30 alky acrylate crosspolymer. | 0.2 |
| Acrylic acid/Lauryl methacrylic acid copolymer (33% active). | 0.17 |
| Glycerol Triacetate-Triacetin | 5.0 |
| Ethoxylated fatty acid | 1.5 |
| 2-Pyrrolidinone, 1-octyl | 1.0 |
| Polyalkyleneoxide modified polydimethylsiloxane (Silwet L-7622) | 2.0 |
| Microbiocide (1.5% Active) | 0.0003 |
| Perfume | 0.35 |
| Deionized Water | to 100 |
| Formulation 2 | |
| Acrylic copolymer. Carboxypolymethylene Acrylates/C10–30 alky acrylate crosspolymer. | 0.2 |
| Acrylic acid/Lauryl methacrylic acid copolymer (33% active). | 0.17 |
| Glycerol Triacetate-Triacetin | 5.0 |
| Ethoxylated fatty acid | 1.5 |
| 2-Pyrrolidinone, 1-octyl | 1.0 |
| Tallow Alkyl bis (Polyethoxy) Ethyl Ammonium, Ethyl sulfate (Adogen 66) | 0.0–5 |
| Polyalkyleneoxide modified polydimethylsiloxane (Silwet L-7622) | 2.0 |
| Microbiocide (1.5% Active) | 0.0003 |
| Perfume | 0.35 |
| Deionized Water | to 100 |

-continued

| CHEMICAL | % ACTIVE LEVEL IN FORMULATION |
|---|---|
| Formulation 3 | |
| Acrylic copolymer. Carboxypolymethylene Acrylates/C10–30 alky acrylate crosspolymer. | 0.2 |
| Acrylic acid/Lauryl methacrylic acid copolymer (33% active). | 0.17 |
| Glycerol Triacetate-Triacetin | 5.0 |
| Ethoxylated fatty acid | 1.5 |
| 2-Pyrrolidinone, 1-octyl | 1.0 |
| Sulfated Canola Oil or Sulfated Castor Oil* | 0.5–5 |
| Polyalkyleneoxide modified polydimethylsiloxane (Silwet L-7622) | 0–2.0 |
| Microbiocide (1.5% Active) | 0.0003 |
| Perfume | 0.35 |
| Deionized Water | to 100 |

*Available from Freedom Chemical company, Charlotte NC

Test Method and Examples

A preferred method of measuring wrinkle reduction is by using the American Association of Textile Chemists and Colorists' (AATCC) method # 124, Appearance of Fabrics after Repeated Home Laundering. In this method, four cloth types (silk, rayon, cotton, and linen) are washed, dried and stored in a well defined way. The dried cloths are then evaluated for wrinkle content by comparison with wrinkle smoothness replicas which can be purchased from AATCC. Factors such as the light used, the angle of the cloths and replicas to the light, and the background are carefully controlled and described in the method. There are six replicas with values of 1, 2, 3, 3.5, 4, and 5 with 5 being perfectly smooth and 1 being very wrinkled. Three trained observers are asked to give a value of 1–5, to the nearest 0.5 unit, to each cloth based on which replica it most closely resembles. The results are totaled and averaged over the three observers for each cloth type. According to the method, a difference of >0.17 between the results for two products indicates there is a significant difference at the 95% confidence level. A difference of greater than or equal to 0.25 indicates a significant difference at the 99% confidence level.

Laboratory tests have shown that when the above formulations are absorbed onto a substrate, such as shown in the figures, and placed in a dryer with clothing, one or more of the identified clothing benefits are achieved. In addition, the formulations have been found effective in stain removal. Stain removal can be achieved before the dryer is activated by rubbing a portion of the substrate, such as a corner, on the stained area.

The substrate having formulation absorbed therein is preferably enclosed in a hermetically sealed pouch. The pouch will preferably inhibit egress of the chemical agents and inhibit ingress of bacteria and other foreign matter. One or more of the pouches can be packed in an enclosed carton for commercial sale. The pouch is preferably manufactured from a heat sealable, foil laminate material.

To freshen clothing, the user simply removes the substrate from the pouch, removes stains by rubbing as needed, places the clothes and substrate into a dryer and runs the dryer. Agents will act on the clothing to reduce wrinkles, reduce odors, reduce stains and/or reduce static. During this process the substrate can contact the inner surfaces of the dryer. The process, as previously discussed, is effective and suitable for use on relatively dry clothing.

While the presently disclosed preferred embodiments provide a clear advantage over the Procter & Gamble Dryel product, it is within the scope of the present disclosure to use the preferred chemicals and substrates, and their equivalents, within the confines of a dryer bag. As such, the use of one or more of the above preferred embodiments within a bag for use in a dryer is also deemed to be within the scope of this disclosure.

Further modifications can also be made without departing from the spirit of this disclosure.

What is claimed is:

1. A method of treating a soiled fabric comprising the steps of:

providing a substrate having between about 20 grams and about 60 grams of a liquid fabric treatment composition applied thereto, the fabric treatment composition comprising from 2.0 to 10.0% by weight of glycerol triacetate, and having at least one ingredient useful for removing stains;

providing a soiled fabric having at least one identifiable stain;

rubbing a portion of the substrate on the identifiable stain, thereby transferring at least a portion of the fabric treatment composition to the fabric;

placing the fabric and the substrate in a drying apparatus;

running the drying apparatus; and allowing the fabric and substrate to contact the inner surfaces of the dryer while running the drying apparatus.

2. A method of decreasing the amount of wrinkles in fabric comprising the steps of:

providing a substrate having between about 20 grams and about 60 grams of a liquid fabric treatment composition applied thereto, the fabric treatment composition comprising from 2.0 to 10.0% by weight of glycerol triacetate, and having at least one ingredient useful for reducing wrinkles in fabric; providing fabric;

placing the fabric and the substrate in a drying apparatus;

running the drying apparatus; and allowing the fabric and substrate to contact the inner surfaces of the dryer while running the drying apparatus.

3. A method of freshening fabric comprising the steps of:

providing a substrate having between about 20 grams to about 60 grams of a liquid fabric treatment composition applied thereto, the fabric treatment composition comprising from 2.0 to 10.0% by weight of glycerol triacetate, and having between about 0.1 wt % to about 1 wt % perfume; providing fabric;

placing the fabric and the substrate in a drying apparatus;

running the drying apparatus; and allowing the fabric and substrate to contact the inner surfaces of the dryer while running the drying apparatus.

* * * * *